US007810428B2

(12) United States Patent
Humal

(10) Patent No.: US 7,810,428 B2
(45) Date of Patent: Oct. 12, 2010

(54) METHOD OF MANUFACTURING PRE-INKED STAMPS AND STAMP MEMBER

(76) Inventor: Leo-Henn Humal, Riia 24 PK 86, Tartu (EE) 51002

( * ) Notice: Subject to any disclaimer, the term of this patent is extended or adjusted under 35 U.S.C. 154(b) by 716 days.

(21) Appl. No.: 11/577,325

(22) PCT Filed: Oct. 19, 2005

(86) PCT No.: PCT/EE2005/000009

§ 371 (c)(1),
(2), (4) Date: Apr. 16, 2007

(87) PCT Pub. No.: WO2006/042560

PCT Pub. Date: Apr. 27, 2006

(65) Prior Publication Data

US 2008/0053325 A1 Mar. 6, 2008

(30) Foreign Application Priority Data

Oct. 19, 2004 (EE) ..... 200400117

(51) Int. Cl.
*B41K 1/50* (2006.01)

(52) U.S. Cl. ..... 101/401.1; 101/333; 101/395

(58) Field of Classification Search ..... 101/401.1, 101/395, 327, 333
See application file for complete search history.

(56) References Cited

U.S. PATENT DOCUMENTS

| | | | | |
|---|---|---|---|---|
| 5,858,298 | A | 1/1999 | Humal | |
| 5,974,969 | A | 11/1999 | Okumura et al. | |
| 6,892,637 | B2 * | 5/2005 | Petersen | 101/333 |
| 2004/0168590 | A1 | 9/2004 | Petersen | |
| 2009/0101032 | A1 * | 4/2009 | Slane et al. | 101/333 |

FOREIGN PATENT DOCUMENTS

| | | |
|---|---|---|
| WO | WO 97/47471 | 12/1997 |

* cited by examiner

*Primary Examiner*—Leslie J Evanisko

(57) ABSTRACT

At stamp manufacturing blank printing plate (3) and inked porous base plate are brought to contact for the moment of creation of printing pattern. Blank stamping member for pre-inked stamp consisting from blank printing plate (3), made from porous thermo-plastic material, printing plate's case (1) and porous base plate (2), filled by ink. Printing plate is attached to the case, but separated from the inked base plate by air clearance, due to what the printing plate is free from ink up to the creation of printing pattern onto its surface, whereas supporting elements (5) are used, that prevent the said air clearance to collapse spontaneously. When the stamping member is compressed in flash moulding machine, the printing plate is pressed against the inked base plate and become inked.

5 Claims, 2 Drawing Sheets

METHOD OF MANUFACTURING PRE-INKED STAMPS AND STAMP MEMBER

TECHNICAL FIELD

This invention belongs to technologies of manufacturing of pre-inked rubber stamps, more precisely it deals with methods, that enable end producers to use industrially produced blank stamps, transferring to its printing plate printing pattern that is prepared electronically on computer.

The said blank stamps consist of stamp mount that has printing plate's case with blank printing plate and means for inking the printing plate that do not need stamp manufacturer to have direct contact with ink.

BACKGROUND ART

Micro porous thermo-plastic materials are used for production of pre-inked stamps, since it is possible to melt and close their surface pores by heating and simultaneous compressing, producing in such a way areas non-permeable for ink, that can be used as non-printing elements of printing plate's printing surface. Method is known for selective closing of surface pores of such materials by heating with light radiation (U.S. Pat. No. 5,858,298, B29C 67/20, L.-H. Humal, 1999), where original of printing pattern, printed on transparent film, is laid onto the surface of thermo-plastic micro porous material, the said material with the said printed pattern is pressed against a smooth transparent body and through the transparent body and film with the original of printing pattern a high intensity light impulse is conducted, that melts and closes selectively the pores on the surface of the said material.

Stamp mount of special design is known that has blank printing plate mounted in it and that comprises an ink ampoule that can be broken by external pressure, allowing ink to flush onto the rear surface of printing plate (U.S. Pat. No. 5,974,969, Okimura et al., 1999).

Another stamp mount is known that comprises an ink cassette, where the printing plate is separated from the ink cassette by a film that can be pulled out (US20040168590, Petersen, 2003). The stamp mount has a gap and the free end of separating film extends out of the said gap. After the printing pattern is created onto the printing plate in flash moulding machine, the separating film is pulled out and the printing plate will be inked.

Technological solution, the closest to this invention, is the method, where ink is let to flush onto the rear surface of the printing plate before the printing pattern is transferred to the blank stamp (WO9747471, B41D 7/00, L.-H. Humal, 1997), whereas ink that covers the rear surface of printing plate enables to press the printing plate, that is mounted into the stamp mount, against the glass of flash moulding machine by hydrostatic pressure, but ink does not reach the surface of printing plate before creation of printing pattern.

The mentioned stamp mounts, in general, enable to manufacture pre-inked rubber stamps by using industrially produced blank stamps, without direct contact of stamp manufacturer with ink. But there are certain shortcomings.

The ink ampoule (U.S. Pat. No. 5,974,969, Okimura et al., 1999) needs too much place and cannot be used in stamp mount of classical design (handle and base plate). Gap, necessary for pulling out the separating film, (US20040168590, Petersen, 2003), adversely affects the strength and production technology of the stamp mount. Either of the solutions can be realized by modification of the existing stamp mounts. As the ink cassette and printing plate (US20040168590, Petersen, 2003) are during compression in flash moulding machine separated by film, ink that is flushed out from base plate by compressing cannot be absorbed by the printing plate, but penetrates out at the sides.

DISCLOSURE OF THE INVENTION

As the solution of the above mentioned problems this invention offers the method of manufacturing pre-inked stamps where stamp member is used that includes printing plate from porous thermo-plastic material and separated from it porous inked base plate, whereas the said printing plate and base plate are pressed together in stamp manufacturing flash moulding machine in such a way that ink is flushed out from base plate by compressing and this ink is absorbed by the printing plate.

Further, this invention offer stamp member for pre-inked stamp that comprises of printing plate from porous thermo-plastic material, printing plate's case and inked porous base plate, whereas for keeping the printing surface free from ink while printing pattern is transferred to it the printing plate is separated from the base plate by air clearance and is supplied by one or several supporting elements that prevent spontaneous collapse of the said air clearance.

As the said supporting elements this invention offers two solutions:

1. the outer rim of printing plate is used as the said supporting element, this outer rim retaining the printing plate in the printing plate's case, but allows it to move inward under sufficient pressure, bringing the printing plate into contact with the base plate, 2. the said supporting elements are formed as integral part of the printing plate.

DESCRIPTION OF THE PREFERRED EMBODIMENTS

Figure 1:
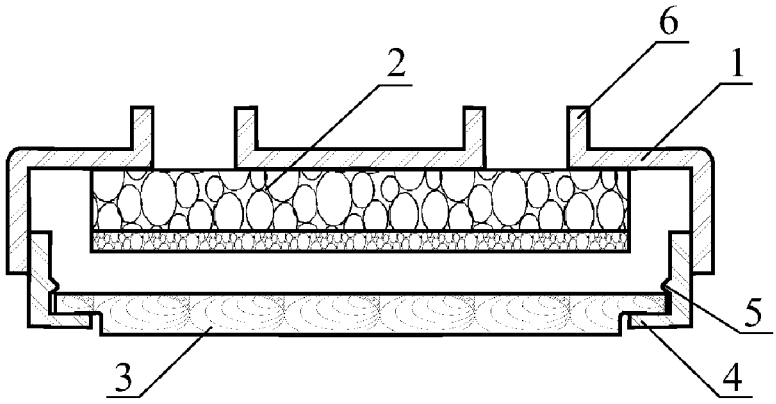
FIG. 1 Stamp member according to the first embodiment.

Stamp mount according to the first embodiment (FIG. 1) comprises of printing plate's case 1, porous base plate 2 filled with ink and printing plate 3 made from porous thermoplastic material. Printing plate 3 is fixed into its rim 4, whereas the rim 4 is supplied with supporting elements, that are realized as inward protruding knobs 5. The rim 4 is adjusted tightly into the case 1, but is only partially pushed in it. The outer surface of the rim 4 and/or inner surface of the case 1 can be supplied with knobs (not shown on the figure), that prevent the free movement of the rim inside the case. Knobs 5 prevent the printing plate 3 to fall against the porous base plate 2. The base plate has two layers sandwiched together, the layer that rests on the bottom of the case 1 being more thick, rigid and having greater bores, upper layer that is near the printing plate 3 being less thick, less rigid and having smaller pores. The printing plate's case 1 is supplied with ports 6, through the ports it is possible ti refill the porous base plate 2 with ink.

Stamp mount according to the first embodiment (FIG. 1) comprises of printing plate's case 1, porous base plate 2 filled with ink and printing plate 3 made from porous thermoplastic material. Printing plate 3 is fixed into its rim 4, whereas the rim 4 is supplied with supporting elements, that are realized as inward protruding knobs 5. The rim 4 is adjusted tightly into the case 1, but is only partially pushed in it. The outer surface of the rim 4 and/or inner surface of the case 1 can be supplied with knobs (not shown on the figure), that prevent the free movement of the rim inside the case. Knobs 5 prevent the printing plate 3 to fall against the porous base plate 2. The base plate has two layers sandwiched together, the layer that rests on the bottom of the case 1 being more thick, rigid and having greater bores, upper layer that is near the printing plate 3 being less thick, less rigid and having smaller pores. The printing plate's case 1 is supplied with ports 6, through the ports it is possible to refill the porous base plate 2 with ink.

Figure 2:
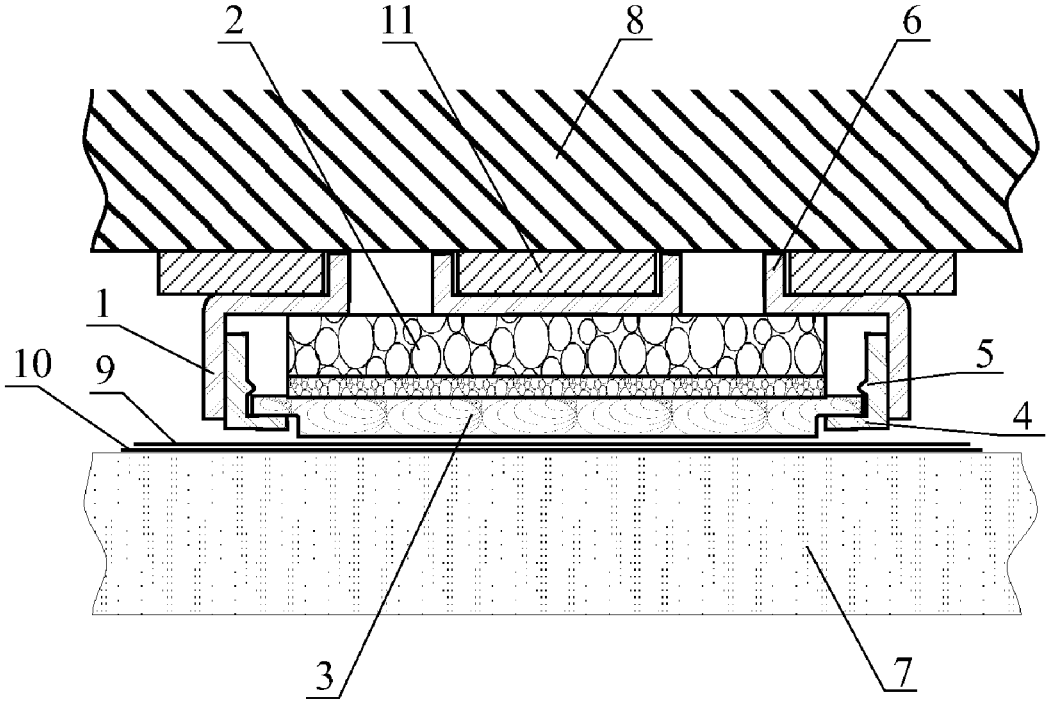
FIG. 2 Stamp mount as it is compressed in the flash moulding machine.

The stamp mount is used as following (FIG. 2). Flash moulding machine has the glass 7 and the pressure plate 8. The original pattern, printed onto transparent material 9, is laid onto the glass 7 and covered with transparent separating film 10. After that, stamp member with printing plate 3 is adjusted above the said films, the printing plate being in contact with the separating film 10, and the stamp member is compressed by pressure plate 8. Additional plate 11 with appropriate openings is used in order to apply regular pressure to the case 1 with ports 6. Under the applied pressure the rim 4 descends entirely into the case 1 and the printing plate comes into contact with the inked base plate 2, that results in penetration of ink into the printing plate 3. Simultaneously the printing plate 3 is pressed together with separating film 10 and film with the original pattern 9 against the glass 7. Then the xenon flash tube (not shown on the figure) under the glass 7 generates a light impulse that selectively melts the surface of the printing plate, creating the printing pattern that corresponds to the original on the film 9. Nevertheless ink from the base plate 2 is already penetrating into the printing plate 3, it is not yet reached the printing surface and does not adversely affect the creation of the printing pattern by selective melting the surface. After exposing with the light impulse the pressure plate 8 is opened and the stamp member is taken out of the machine and is adjusted into the stamp mount. The printing plate 3 retains its contact with the base plate 2. After a certain time interval (from 10 minutes to 2 hours) printing plate will be inked and the stamp will be ready to use.

Figure 3:
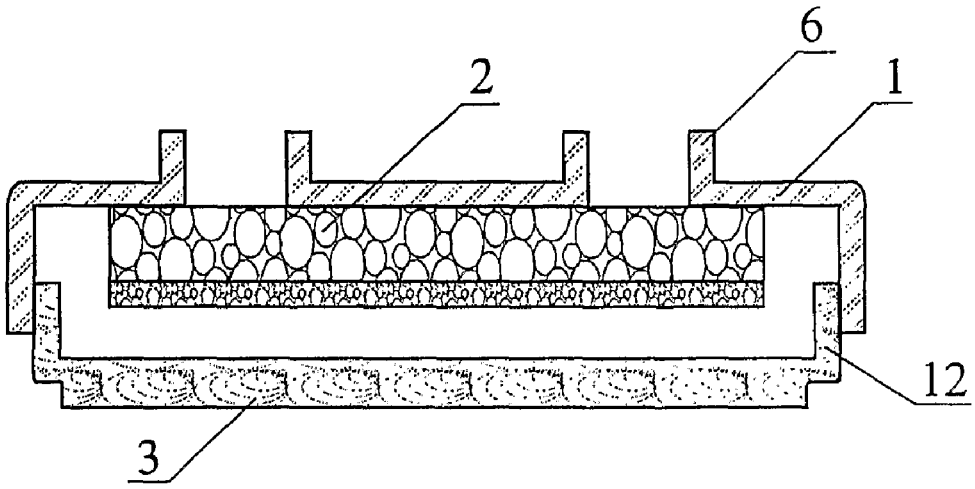
FIG. 3 Stamp mount according to the second embodiment.

Stamp mount according to the second embodiment (FIG. 3) comprises of printing plate's case 1, porous base plate 2 filled with ink and printing plate 3 made from porous thermo-plastic material. The edges of the printing plate 3 are formed by melting in such a way, that a rigid rim 12 is created. The rim 12 is adjusted tightly into the case 1, but is only partially pushed in it. The rim 12 serves as supporting element that prevent the printing plate 3 to fall against the porous base plate 2. The base plate has two layers sandwiched together, the layer that rests on the bottom of the case 1 being more thick, rigid and having greater bores, upper layer that is near the printing plate 3 being less thick, less rigid and having smaller pores. The printing plate's case 1 is supplied with ports 6, through the ports it is possible to refill the porous base plate 2 with ink.

The use of stamp mount of second embodiment is analogous to the stamp mount of the first embodiment. When the stamp member is compressed between the pressure plate and glass plate, the rim 12 slides on the inner surface of the case 1 and descends entirely into and the printing plate comes into contact with the inked base plate 2.

Figure 4:
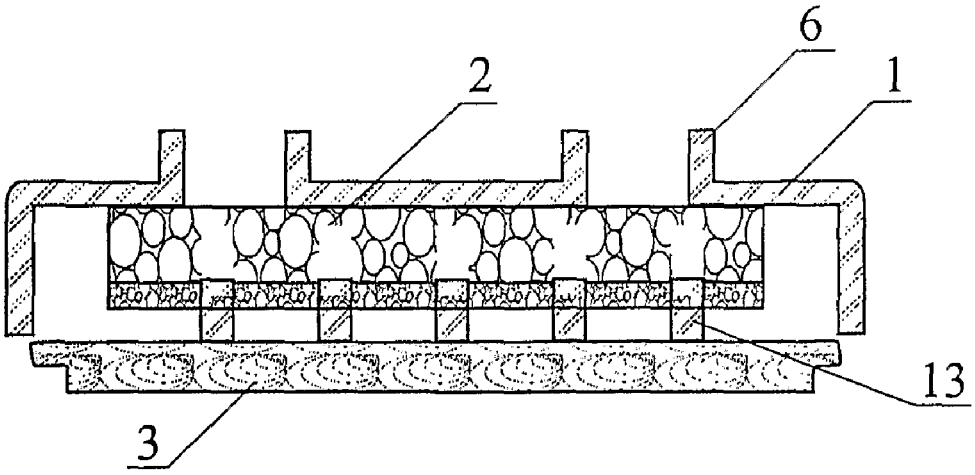
FIG. 4 Stamp mount according to the third embodiment.

Stamp mount according to the third embodiment (FIG. 4) comprises of printing plate's case 1, porous base plate 2 filled with ink and printing plate 3 made from porous thermo-plastic material. Pins 13 are fastened on the rear surface of the printing plate, the pins being partially pressed into the base plate 2 thus connecting the printing plate with its case and simultaneously serving as supporting elements that prevent the printing plate 3 to fall against the porous base plate 2. The base plate has two layers sandwiched together, the layer that rests on the bottom of the case 1 being more thick, rigid and having greater bores, upper layer that is near the printing plate 3 being less thick, less rigid and having smaller pores. The printing plate's case 1 is supplied with ports 6, through the ports it is possible to refill the porous base plate 2 with ink.

The use of stamp mount of third embodiment is analogous to the stamp mount of the first embodiment. When the stamp member is compressed between the pressure plate and glass plate, the pins 13 intrude entirely into the base plate 2 and the printing plate 3 comes into contact with the inked base plate 2.

The use of all the three embodiments of stamp member, as described above, fall under the method according to claim 1. But the claimed method can be used with certain stamp members that are different from the embodiments above. For example, it is possible to use the stamp mount as described in background art (US20040168590, Petersen, 2003), but the separating film is pulled out before the creation of the printing pattern onto the printing plate.

INDUSTRIAL APPLICABILITY

The method can be realized using stamp mounts of standard design that are only slightly modified. For example, Stamp mounts of "Impressor" series of company "Trodat" can be used, that have printing plate cases supplied with retainer rim, produced by injector moulding, only knobs 5 (FIG. 1) shall be formed, using, for example, hot press deforming technology.

The invention claimed is:

1. A method of manufacturing a pre-inked stamp comprising the steps of:

providing a stamp member having a printing plate made of porous thermo-plastic material and a porous inked base plate initially separated from the printing plate;

placing the stamp member in a stamp manufacturing flash molding machine for creation of a printing pattern on the printing plate surface, and pressing the printing plate and porous inked base plate together such that the porous inked base plate is compressed so as to flush out ink from the porous inked base plate; and absorbing the flushed out ink by the printing plate to provide the pre-inked stamp.

2. A stamp member comprising:

a printing plate case housing a printing plate made of porous thermo-plastic material and an inked porous base plate, the printing plate having a printing surface to be imaged with a printing pattern, the printing plate being separated from the inked porous base plate by an air clearance, the stamp member further comprising one or several supporting elements that prevent spontaneous collapse of the air clearance between the printing plate and inked porous base plate but allow contact between the printing plate and inked porous base plate when pressure is applied to the printing plate case during imaging of the printing pattern on the printing surface to allow ink from the inked porous base plate to penetrate into the printing plate.

3. The stamp member according to claim 2, further comprising an outer rim on the printing plate, wherein the outer rim comprises the one or several supporting elements.

4. The stamp member according to claim 2, characterized in that the one or several supporting elements are formed as integral parts of the printing plate.

5. The stamp member according to claim 2, further comprising pins fastened on a rear surface of the printing plate, the pins comprising the one or several supporting elements.

* * * * *